US005632486A

United States Patent [19]

Mkrtchyan

[11] Patent Number: 5,632,486

[45] Date of Patent: May 27, 1997

[54] METHOD OF PLAYING A CARD GAME USING CARD NUMBER SUBSTRACTION TECHNIQUES

[76] Inventor: Vachagan Mkrtchyan, 1502 Maple St. # "B" , Glendale, Calif. 91205

[21] Appl. No.: 593,518

[22] Filed: Jan. 30, 1996

[51] Int. Cl.[6] ..... A63F 1/00

[52] U.S. Cl. ..... 273/292; 273/303

[58] Field of Search ..... 273/292, 274, 273/309, 303

[56] References Cited

U.S. PATENT DOCUMENTS 5,013,049 5/1991 Tomaszewski ..... 273/292

5,368,305 11/1994 Rodda et al. ..... 273/292

OTHER PUBLICATIONS

"Blackjack" and Seven and a Half, Scarne's Encyclopedia Of Games, Harper & Row Publishers, pp. 276–286, 288–289. 1973.

*Primary Examiner*—Benjamin H. Layno

*Attorney, Agent, or Firm*—Erik M. Arnhem

[57] ABSTRACT

A card game, on the order of blackjack, is played with at least one deck of cards, with sevens, eights, nines and tens removed. Each card has an assigned point value. Each player is dealt two cards face down, with an option to receive a third, in addition to the two cards initially received. The winning hand is the hand having the lowest point total, wherein the point total is the difference between the points for the cards in the person's hand. The lowest possible total is zero, achieved, e.g. when the two cards in the hand are the same number, hence same point value.

3 Claims, 1 Drawing Sheet

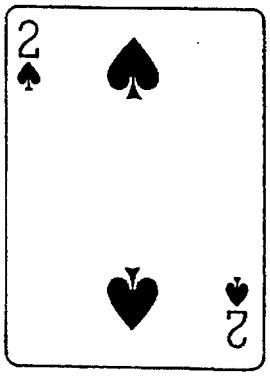
AND
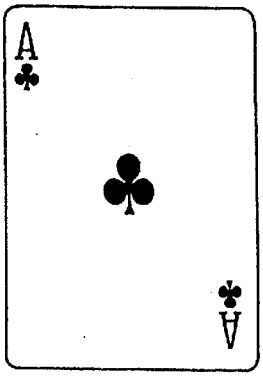
= 1
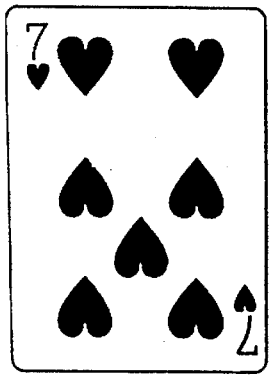
AND
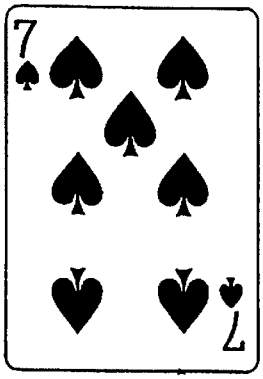
= 0
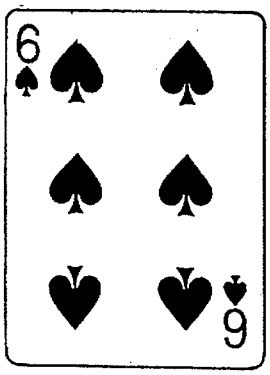
AND
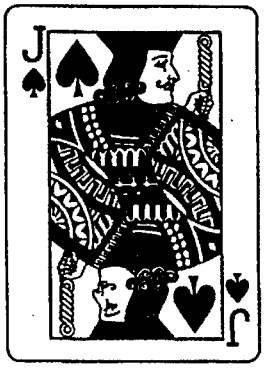
= 6
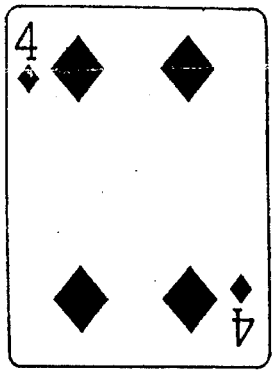
AND
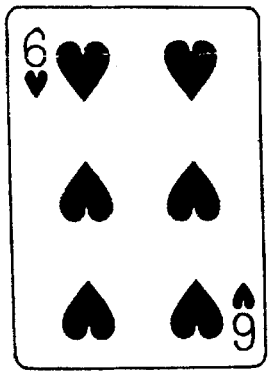
= 2

METHOD OF PLAYING A CARD GAME USING CARD NUMBER SUBSTRACTION TECHNIQUES

BACKGROUND AND SUMMARY OF THE INVENTION

This invention relates to a card game wherein the object is to obtain a hand having a relatively low card point value; the game is played similarly to the game of blackjack, except that card values are subtracted rather than added.

The closest prior art is believed to be a series of patents that disclose variants of the game of blackjack. In each of these patent disclosures the point values of cards in each player's hand are added together to determine the value of the hand. Different hands are compared to determine the winning hand; in most cases each player competes separately against the dealer, as in the game of blackjack. The game of the present invention differs from the corresponding patented games primarily in the fact that the point value of each hand is determined by the difference in point value of the cards in the person's hand. The object of the game is to achieve a hand wherein the point value difference is zero, or as close as possible to zero.

U.S. Pat. No. 5,314,193, issued to E. Ferrer, discloses a card game wherein the cards in each player's hand are given specific values, with the card values being added together to determine the winning hand. According to the game rules, each ace has a value of one, each face card has a value of one half, and each card from 2 through 10 has its indicated value. The winning hand is the hand having the highest total value that includes one half point e.g. a seven and one half point total, or a nine and one half point total. Each player receives two cards, with the option of receiving up to two additonal cards, should the player believe such cards will improve his hand.

U.S. Pat. No. 5,366,228 discloses a card game that is somewhat similar to blackjack, in that each player plays his hand against the dealer's hand, with the winner being the person having the highest total value coming closest to nine. Each player receives two cards, with the option to receive a third card if he believes such a card will improve his hand. Cards from Ace through nine have their indicated values; cards numbered ten through king have zero value. When computing the point value of any hand, point totals greater than ten are automatically reduced by ten; e.g. a point value of fifteen automatically becomes five for valuation purposes. As noted above, the winner is the hand having a point total coming closest to nine.

U.S. Pat. No. 5,368,305, issued on Nov. 29, 199 to J. Rodda et al, discloses a card game which uses a standard deck of cards, with the eights, nines and tens removed. The remaining cards are given point values, wherein the aces through sevens have their indicated values, and the face cards have a value of one half point. The winner is the person whose hand comes closest to a total of seven and one half points, without exceeding seven and one half points; e.g. a hand totalling six points will beat a hand totalling five and one half points. A hand totalling eight or more points is automatically a losing hand. The game can be played according to the same rules and procedures as are used in blackjack.

U.S. Pat. No. 5,397,128, issued to M. Hesse on Mar. 14, 1995, discloses a card game, wherein point values are assigned to the cards; each seven, eight and ten is removed from a conventional deck to produce a playing deck. Each ace has a value of one; cards 2 through 6 and 9 have their indicated values, the face cards have a zero valuation. The object of the game is to achieve a point total coming as close as possible to nine without exceeding nine. Each player is dealt three cards, with the player having the option of receiving an additional card if he believes it will improve his hand. The game, in major aspects, is similar to the games disclosed in above-mentioned U.S. Pat. Nos. 5,368,305 and 5,366,228.

U.S. Pat. Nos. 5,407,208 and 5,411,268 disclose card games that are variations of the well known game of blackjack. In the patented games the winner is the person whose hand has a point total closest to twenty one, without exceeding twenty one.

The present invention relates to a game wherein each player is dealt two cards, with the option of receiving a third additional card should the player believe that a third card will improve his hand. One or more conventional decks of cards with certain cards removed, can be used in the game. Each card has an assigned point value, e.g. aces are assigned a value of one, face cards are assigned a zero value, and cards numbered two through seven are assigned their indicated value (two through seven, respectively).

The object of the game is to achieve a hand (containing two cards), wherein the card point value is zero, or as close as possible to zero. Point values for each hand are obtained by subtracting the values of each card in the hand, so as to obtain a numerical value. For example, a hand containing a two of spades and an ace of diamonds would have a value of one (the difference between 2 and 1). A hand containing a three of clubs and a jack of hearts would have the value of three (the difference between 3 and 0). As between these two hands, the winner would be the first hand, since it is closer to zero than the second hand. When valuing each hand the suit of the card is disregarded; e.g. a card in the club suit can be subtracted from a card game in any other suit without changing the result.

The game can be played, using the basic principles of blackjack. The dealer or a player banker, when applicable as a legal requirement, will deal each player two cards face down as well as two cards to himself; each player can look at his cards to determine whether he wants to receive a third card or not in addition to the two cards initially received. The dealer similarly has also the option to receive a third card. If a third card is received, the two previous cards are played as a single card with one subtracted value.

When all of the participants in the game have received the permitted number of cards (two or three cards per person) the cards are exposed to determine the value of each hand. As previously noted, the hand having the lowest point value is the winner.

The game can be played so that each player competes against the dealer. Alternately, the game can be played so that all of the participants compete against each other. In this latter situation, when two or more of participants have the same lowest point value hands, there is no action and the players retain their respective bets.

Betting can take place at various stages in the game, preferably prior to any cards being dealt, but also after two cards have been dealt. The betting procedures will be affected, to a certain extent, by whether each player is competing only against the dealer, or all participants are competing against each other.

Certain ancillary rules may be established to increase player interest and initiative. For example, the rules may stimulate that all participants (players and dealer) must take a third card if the card point value of the first two cards is three or higher. This rule promotes activity on the part of each player, leading to potentially lower point values and closer games.

THE DRAWINGS

The single FIGURE of the drawing shows four representative hands that can be held by any game participant, together with the point value of each hand. The figure illustrates how the hands can be evaluated and compared.

DESCRIPTION OF A PREFERRED EMBODIMENT OF THE INVENTION

The game is played with one or more decks of playing cards, with selected cards removed. Typically, all of the eights, nines and tens are removed. Optionally some of the face cards can be removed (to minimize the number of face cards in the playing deck). The cards are assigned the following point values, with no distinction between the suits.

Ace of any suit—1 point

Two of any suit—2 points

Three of any suit—3 points

Four of any suit—4 points

Five of any suit—5 points

Six of any suit—6 points

Seven of any suit—7 points

Any face card—0 points

In preferred practice of the invention, each player competes against the dealer, not against the other players. The dealer deals two cards, face down, to each game participant (players and dealer); each person has an opportunity to view his own cards (but not the dealer's cards). One rule that can be established, may require that if the value of the cards in any player's hand is three or greater, that the player receives a third card (face down) from the dealer. Similarly if the cards in the dealer's hand total three or greater, then he must deal himself a third card.

Betting can take place prior to the cards being dealt. Optionally, each player can place an additional bet after he has received his cards (two or three cards, at his option). After the cards have been dealt to all players and the dealer, the cards of each participant are turned up to determine the winning hand(s). Each hand is evaluated for card point total, using substraction prodedures, as previously outlined.

The attached drawings show illustrative hands, and the corresponding point values. With respect to the illustrated hands, as between any two hands, the second hand (point value zero) is the winner, followed by the first hand (point value 1), the last hand (point value 2), and the third hand (point value 6). If the dealer and a particular player should have the same point value, there is no action.

Low point values can be achieved in various ways, e.g. two cards having the same number, or two face cards. A certain degree of strategy can be used in an effort to achieve a low point value. For example, if a participant holds a face card and a six he should take another card, because this can only be to his advantage, i.e. he may get another six and end up with a zero value. With some hands, some thought is required to make the best decision, whether to hold the original two cards, or to ask for another card (which may or may not improve the hand).

In preferred practice of the invention all of the sevens, eights, nines and tens are removed (not used). The principal reason for this is to increase the probabilities for low point totals; high card-low card combinations produce undesirably high point totals.

The game is preferably played so that each player competes with the dealer, but not the other players. However, with certain rule changes, the game can be played so that all of the game participants compete with each other. In that case the person having the lowest card total (difference between the values for the two cards) takes the entire pot of money bet; in case of two persons' having the same "lowest card" total, the money bet by each person is returned.

The above description outlines the fundamentals of the game. However, it will be appreciated that various ancillary rules and procedures can be employed in playing the game, rules for rotating the deal, or deciding which cards to remove from the deck, or determining when a game participant is required to draw a third card.

What is claimed is:

1. A method of playing a card game, wherein cards in the playing deck are assigned numerical point values;

said method comprising:

removing only the eights, nines and tens cards from a standard deck of fifty two cards, to establish a playing deck of forty cards;

assigning to each numbered card in the playing deck its indicated value, assigning to each face card in the playing deck a value of zero; and assigning to each ace in the playing deck a value of one;

initially dealing two cards to each player, with each player having the option of receiving a third card; and comparing competing hands to determine a winning hand, with the winning hand being the hand wherein the point value difference between the two cards in the hand is the closest to zero.

2. The method of claim 1, wherein the game is played by a dealer and several individual players, with each player competing against the dealer but not against the other players.

3. The method of claim 1, wherein the game is played by a dealer and several individual players, with the dealer and all players competing against one another.

* * * * *